US006015269A

United States Patent [19]

Ota et al.

[11] Patent Number: 6,015,269

[45] **Date of Patent: *Jan. 18, 2000**

[54] VARIABLE DISPLACEMENT COMPRESSOR

[75] Inventors: Masaki Ota; Masaru Hamasaki; Masayoshi Hori; Hisakazu Kobayashi; Satoshi Koumura; Yasunori Makino, all of Kariya, Japan

[73] Assignee: Kabushiki Kaisha Toyoda Jidoshokki Seisakusho, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/986,115

[22] Filed: Dec. 5, 1997

[30] Foreign Application Priority Data

| | | | |
|---|---|---|---|
| Dec. 10, 1996 | [JP] | Japan | 8-329828 |
| Feb. 6, 1997 | [JP] | Japan | 9-024137 |
| Sep. 24, 1997 | [JP] | Japan | 9-259067 |

[51] Int. Cl.[7] ..... F04B 1/26; F04B 1/12

[52] U.S. Cl. ..... 417/222.2; 417/269

[58] Field of Search ..... 417/222.2, 313, 417/269

[56] References Cited

U.S. PATENT DOCUMENTS

| | | | |
|---|---|---|---|
| 5,586,870 | 12/1996 | Kawaguchi et al. | 417/222.2 |
| 5,616,008 | 4/1997 | Yokono et al. . | |
| 5,636,974 | 6/1997 | Iked et al. | 417/269 |
| 5,655,432 | 8/1997 | Wilkosz | 92/71 |

FOREIGN PATENT DOCUMENTS

| | | | |
|---|---|---|---|
| 196 12 384 A1 | 10/1996 | Germany . | |
| 08-114182 | 5/1996 | Japan . | |

*Primary Examiner*—Charles G. Freay
*Assistant Examiner*—Paul L. Ratcliffe
*Attorney, Agent, or Firm*—Morgan & Finnegan, L.L.P.

[57] ABSTRACT

A variable type compressor has a housing that houses a crank chamber and rotatably supports a drive shaft. Part of the housing is constituted by a cylinder block. Cylinder bores extend through the housing about the drive shaft. A piston is accommodated in each cylinder bore. A discharge chamber is defined in the housing and connected to the crank chamber by a pressurizing passage. An inclinable cam plate is supported on the drive shaft. The reciprocation of each piston draws refrigerant gas into the associated cylinder bore from a suction chamber and discharges the refrigerant gas into the discharge chamber through a discharge port. The displacement and the discharge of refrigerant gas is controlled by altering the inclination of the cam plate. A collection compartment is provided to receive the refrigerant gas discharged from the cylinder bores. Oil is separated from the refrigerant gas in the collection compartment. The inlet of the pressurizing passage is connected with the collection compartment to supply the separated oil to the crank chamber.

32 Claims, 11 Drawing Sheets

VARIABLE DISPLACEMENT COMPRESSOR

BACKGROUND OF THE INVENTION

The present invention relates to variable displacement compressors that are employed in automobile air-conditioners.

A typical variable type compressor has a crank chamber housed in a housing and a rotatable drive shaft. The housing includes a cylinder block. Cylinder bores extend through the cylinder block about the drive shaft. A piston is accommodated in each cylinder bore. Each cylinder bore is connected to a discharge chamber through a discharge port. Refrigerant gas is compressed in each cylinder bore and discharged into the discharge chamber.

A pressurizing passage extends between the discharge chamber and the crank chamber. The compressed refrigerant gas in the discharge chamber is sent to the crank chamber through the pressurizing passage. The pressurizing passage has an inlet, which is opened to the discharge chamber, and an outlet, which is opened to the crank chamber. A discharge passage is also provided to return the refrigerant gas in the discharge chamber to an external refrigerant circuit.

A cam plate is fitted to the drive shaft in the crank chamber. The cam plate is supported in a manner such that it may incline while rotating integrally with the drive shaft. The peripheral portion of the cam plate is coupled to each piston. The inclination angle of the cam plate with respect to the axis of the drive shaft is altered to adjust the displacement of the compressor.

In this type of variable displacement compressor, the inlet of the pressurizing passage is located near the inlet of the discharge passage in the discharge chamber. Furthermore, the inlet of the discharge passage is located near the discharge port of each cylinder bore. Thus, when compressed refrigerant gas is discharged into the discharge chamber from the discharge port of each cylinder bore, some of the gas enters the discharge passage. This obstructs the flow of refrigerant gas from the pressurizing passage to the crank chamber.

When the compressor displacement is small, a large amount of hot pressurized refrigerant gas is sent to the crank chamber from the discharge chamber. However, it is difficult to continue sufficient lubrication of contacting parts in the crank chamber when the temperature and pressure in the crank chamber is high. Under such conditions, thermal expansion of mechanical components takes place and reduces the clearances provided between cooperating components. In addition, the viscosity of the lubricating oil suspended in the refrigerant gas may be decreased. As a result, the lubrication of the contacting parts may become insufficient.

This problem has been dealt with in various ways in the prior art. For example, the surface of the cam plate may be treated by thermal spraying a metal material such as copper to portions that contact other components. However, such treatment is costly and increases the weight of the cam plate. Furthermore, this increases the manufacturing cost and weight of the compressor.

Also, if the compressed refrigerant gas sent to the external refrigerant circuit includes a large amount of oil, a thick film of oil may form on the heat conducting surfaces of downstream devices, such as the condenser or the evaporator. This may reduce the heat exchanging efficiency of the heat exchanging devices and thus may reduce the refrigeration efficiency.

SUMMARY OF THE INVENTION

Accordingly, it is an objective of the present invention to provide a variable displacement compressor that effectively delivers oil into the crank chamber for sufficient lubrication of contacting parts in the crank chamber.

A further objective of the present invention is to provide a variable displacement compressor that is light and economical.

To achieve the above objectives, the present invention provides a variable displacement type compressor. The compressor has a crank chamber defined in a housing. A drive shaft is rotatably supported by a housing. A plurality of cylinder bores are defined in a cylinder block to surround the drive shaft. A piston reciprocates within the associated cylinder bore. A supply passage communicates a discharge chamber within the housing to the crank chamber. A discharge port is associated with each cylinder bore. A cam plate is tiltably supported on the drive shaft. When each piston reciprocates, a refrigerant gas is drawn into the associated cylinder bore from a suction chamber and discharged from the associated cylinder bore to the discharge chamber via the associated discharge port. The amount of gas discharged from the bores is controlled by varying the inclination of the cam plate. The compressor includes a collection compartment for receiving the refrigerant gas discharged from the cylinder bores. An inlet of the supply passage opens to the collection compartment.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 18(*b*) is a graph showing the results of the experiment; and

DETAILED DESCRIPTION OF THE PREFERRED EMBODIMENTS

A first embodiment of a variable type compressor according to the present invention will now described with reference to FIGS. 1 to 3.

Figure 1:
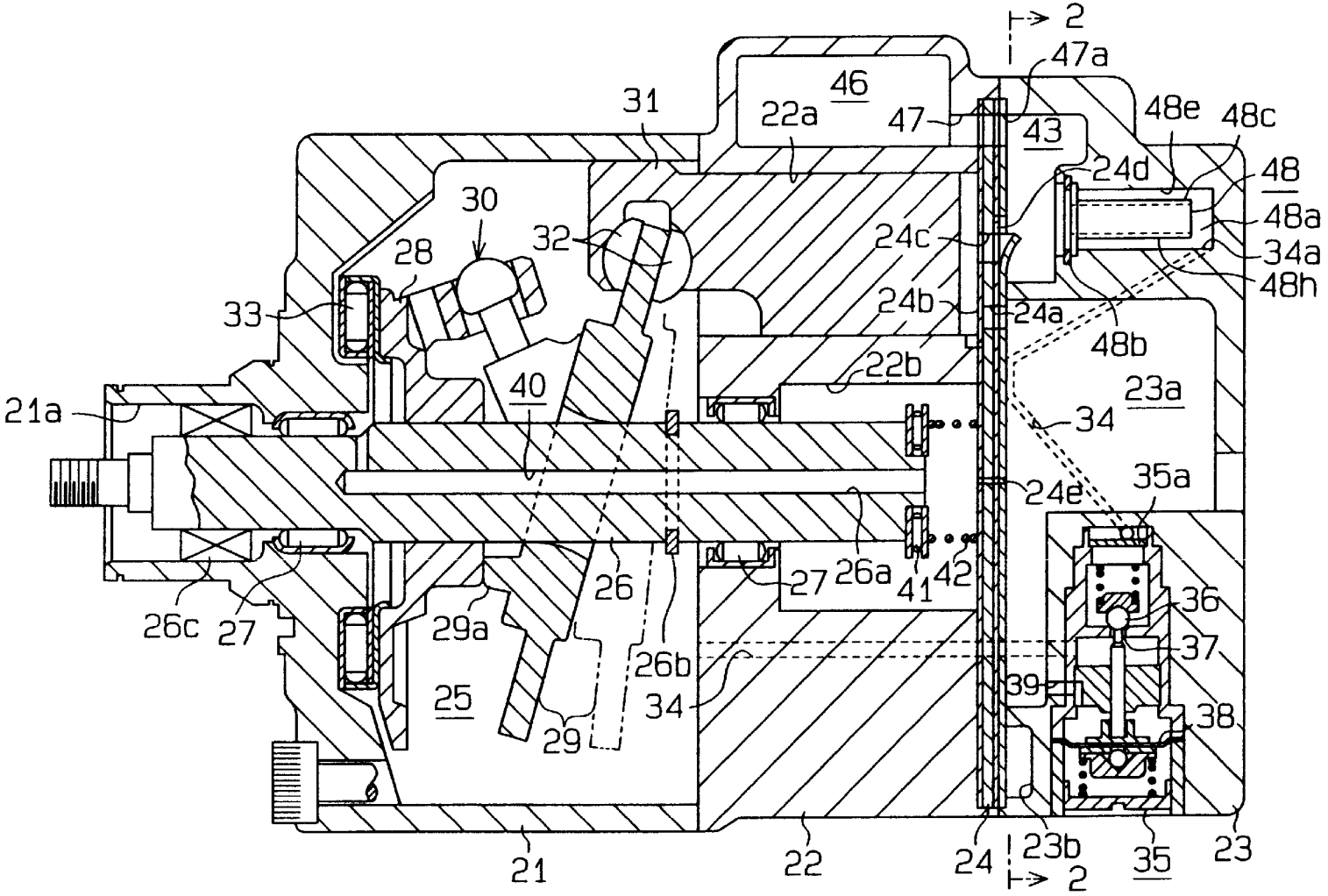
FIG. 1 is a cross-sectional view showing a first embodiment of a variable displacement compressor according to the present invention.

As shown in FIG. 1, a front housing 21 is fixed to the front end of a cylinder block 22. A rear housing 23 is fixed to the rear end of the cylinder block 22 with a valve plate 24 arranged in between. The front housing 21, the cylinder block 22, and the rear housing 23 constitute a housing.

Figure 2:
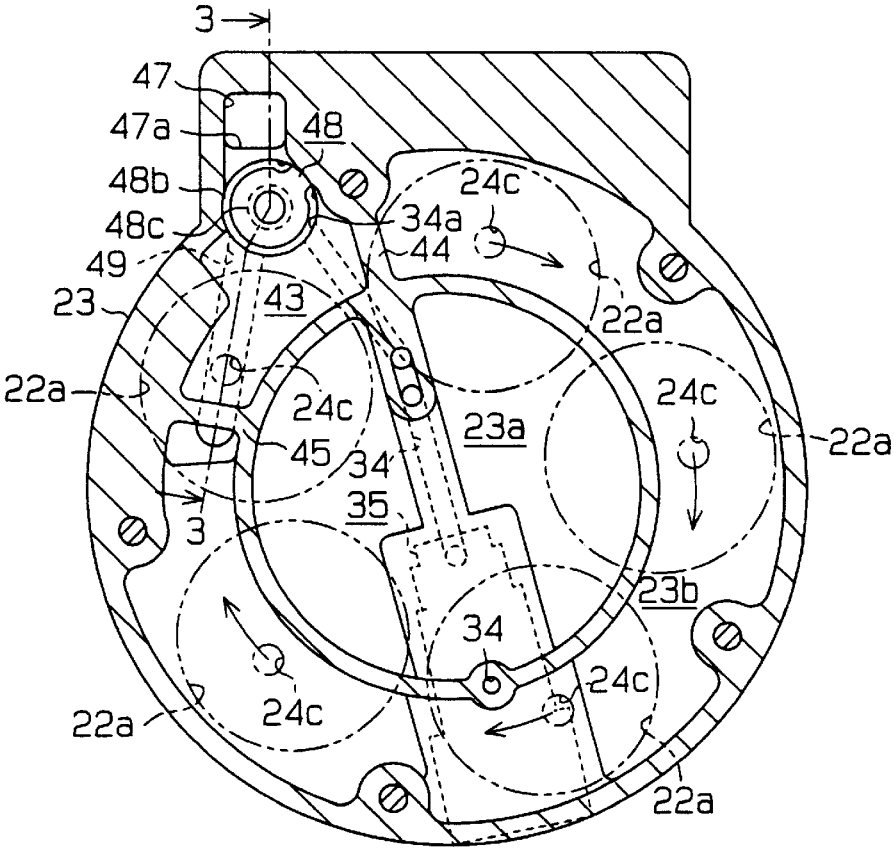
FIG. 2 is a cross-sectional view taken along line 2—2 in FIG. 1.

As shown in FIGS. 1 and 2, a suction chamber 23*a* is defined in the central portion of the rear housing 23, while an annular discharge chamber 23*b* that is included is defined in the peripheral portion of the rear housing 23. Suction ports 24*a* and discharge ports 24*c* are provided in the valve plate 24. A suction flap 24*b* is provided for each suction port 24*a*, while a discharge flap 24*d* is provided for each discharge port 24*c*.

A crank chamber 25 is defined in the front housing 21 in front of the cylinder block 22. A drive shaft 26 extends through the crank chamber 25. A radial bearing 27 is arranged in the front housing 21 and in the cylinder block 22 to rotatably support the drive shaft 26.

The front end of the drive shaft 26 extends through a front opening 21*a* of the front housing 21 for connection with an external drive source, such as an automotive engine, by means of a clutch (not shown). A lip seal 26*c* is arranged between the peripheral surface of the drive shaft 26 and the inner surface of the front opening 21*a* of the front housing 21. The lip seal 26*c* prevents the refrigerant gas in the crank chamber 25 from leaking externally. A central bore 22*b* is provided in the rear portion of the cylinder block 22. A thrust bearing 41 and a shaft support spring 42 are arranged between the rear end of the drive shaft 26 and the valve plate 24 in the central bore 22*b*.

A rotor 28 is fixed to the drive shaft 26. A cam plate, or swash plate 29, is fitted on the drive shaft 26. The swash plate 29 is supported so that it slides in the axial direction of the drive shaft 26 while inclining with respect to the axis of the drive shaft 26. A hinge mechanism 30 couples the swash plate 29 to the rotor 28. The hinge mechanism 30 guides the sliding and inclining of the swash plate 29 and rotates the swash plate 29 integrally with the drive shaft 26.

The swash plate 29 is located at a maximum inclination position when its stopper 29*a* abuts against the rotor 28. The swash plate 29 is located at a minimum inclination position when the swash plate 29 abuts against an inclination restriction ring 26*b*, which is fitted on the drive shaft 26.

Cylinder bores 22*a* extend through the cylinder block 22 about the drive shaft 26. The head of a single-headed piston 31 is accommodated in each cylinder bore 22*a*. The skirt of each piston 31 is coupled to the peripheral portion of the swash plate 29 by a pair of semi-spheric shoes 32. Rotation of the drive shaft 26 causes the swash plate 29 to reciprocate each piston 31 in the associated cylinder bore 22*a*. This compresses refrigerant gas in the cylinder bore 22*a*. The reaction force resulting from the compression of the refrigerant gas is received by the front housing 21 through the shoes 32, the swash plate 29, the hinge mechanism 30, the rotor 28, and a thrust bearing 33.

The swash plate 29 is die cast from aluminum alloy. The aluminum alloy includes hard particles that are formed from eutectic or hyper-eutectic silicon. It is preferable that the percentage content of the silicon in the aluminum alloy be in the range of 8 to 25 wt %. It is further preferable that the percentage content of the silicon be in the range of 14 to 20 wt %. It is still further preferable that the percentage content of the silicon be in the range of 16 to 18 wt %. A percentage content lower than 8 wt % lowers the anti-wear property of the swash plate 29 to an undesirable level. On the other hand, a percentage content higher than 25 wt % increases the viscosity of the melted aluminum alloy to an undesirable level and causes difficulties during die casting.

It is preferable that the average particle diameter of the eutectic or hyper-eutectic silicon be in the range of 10to 60 microns. It is further preferable that the average particle diameter be in the range of 30 to 40 microns. It is still further preferable that the average particle diameter be in the range of 34 to 37 microns. An average particle diameter smaller than 10 microns or larger than 60microns lowers the anti-wear property of the swash plate 29 to an undesirable level.

A supply passage, or pressurizing passage 34, extends through the cylinder block 22 and the rear housing 23 to connect the discharge chamber 23*b* and the crank chamber 25. A displacement control valve 35 is provided in the pressurizing passage 34. The control valve 35 has a valve hole 37 and a valve body 36, which is aligned with the valve hole 37. A diaphragm 38 is arranged in the control valve 35. A pressure sensing passage 39 connects the suction chamber 23*a* to the interior of the control valve 35. The pressure of the suction chamber 23*a*, which is communicated through the pressure sensing passage 39, acts on the diaphragm 38 and adjusts the area of the valve hole 37 opened by the valve body 36. Thus, the valve body 36 and the valve hole 37 function as a restriction in the pressurizing passage 34.

The adjustment of the opened amount of the control valve 35 changes the amount of compressed refrigerant gas sent through the pressurizing passage 34 from the discharge chamber 23*b* to the crank chamber 25. This changes the difference between the pressure in the crank chamber 25, which acts on the crank chamber side of each piston 31, and the pressure in the cylinder bores 22*a*, which act on the head of the associated piston 31. Changes in the pressure difference alters the inclination of the swash plate 29. This, in turn, alters the stroke of each piston 31 and adjusts the displacement of the compressor.

A filter 35*a* is provided at the inlet of the control valve 35 to filter the compressed refrigerant gas entering the control valve 35 from the discharge chamber 23*b*.

A relief passage 40 extends through the drive shaft 26, the cylinder block 22, and the valve plate 24 to connect the crank chamber 25 to the suction chamber 23*a*. The relief passage 40 is constituted by a conduit 26*a* extending through the axis of the drive shaft 26, the central bore 22*c* of the cylinder block 22, and a pressure releasing hole 24*e* provided in the center of the valve plate 24. The conduit 26*a* has an inlet, which is located at the vicinity of the front radial bearing 27 and is connected with the crank chamber 25.

The structure of the discharge chamber 23*b* will now be described in detail.

Figure 3:
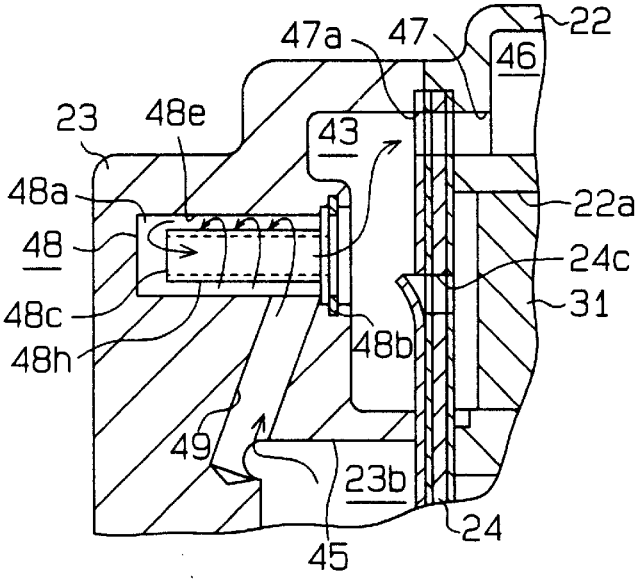
FIG. 3 is a partial cross-sectional view taken along line 3—3 in FIG. 2.

As shown in FIGS. 1 to 3, a collection compartment 43 is defined between a first partition 44 and a second partition 45 in the discharge area, specifically discharge chamber 23*b*. The cylinder block 22 has a muffler 46, which is communicated with the collection compartment 43 through a discharge passage 47. In the collection compartment 43, the inlet 47*a* of the discharge passage 47 is located near the first partition 44.

The discharge port 24*c* of one of the cylinder bores 22*a* is located in the collection compartment 43. The discharge ports 24*c* of the other cylinder bores 22*a* are located outside the collection compartment 43 in the discharge chamber 23*b*. The compressed refrigerant gas discharged into the discharge chamber 23*b* from the discharge ports 24*c* of the cylinder bores 22*a* flows toward the collection compartment 43 as indicated by the arrows in FIG. 2.

An oil separator 48 is provided in the collection compartment 43. The oil separator 48 includes a separation cell 48*a* and a separation tube 48*c*, which is fixed in the separation cell 48*a* by a snap ring 48*b*. The cylindrical wall surface of the separation cell 48*a* defines a separation surface 48*e*. A predetermined distance is provided between the peripheral surface 48*h* of the separation tube 48*c* and the separation surface 48*e*. An acceleration passage 49 extends through the second partition 45 from the upstream side of the oil separator 48. The first partition 44 separates the discharge chamber 23*b* from the collection compartment 43. The acceleration passage 49 and the separation cell 48*a* connect the discharge chamber 23*b* with the collection compartment 43.

The compressed refrigerant gas in the discharge chamber 23*b* hits the second partition 45 and changes directions. The refrigerant gas then enters the acceleration passage 49 to be guided to the separation cell 48*a* of the oil separator 48. As indicated by the arrows in FIG. 3, the refrigerant gas then swirls about the separation tube 48*c* between its peripheral surface 48*h* and the separation surface 48*e*. Afterwards, the refrigerant gas passes through the separation tube 48*c* and enters the discharge passage 47. As the refrigerant gas flows by the separation surface 48*e*, the separation surface 48*e* acts to separate lubricating oil from the refrigerant gas. The separated oil collects in the separation cell 48*a*.

As shown in FIGS. 1 and 2, the inlet 34*a* of the pressurizing passage 34 is connected with the separation cell 48*a* at the bottom of the separation surface 48*e*. Therefore, the crank chamber 25 is supplied with lubricating oil, which is collected in the separation cell 48*a*, with the compressed refrigerant gas when the control valve 35 is opened.

The operation of the variable displacement compressor will now be described.

As the external drive source rotates the drive shaft 26, the rotor 28 and the hinge mechanism 30 rotate the swash plate 29 integrally with the drive shaft 29. The rotation of the swash plate 29 is converted to linear reciprocation of the pistons 31 in the associated cylinder bores 22*a*. As each piston 31 moves from its top dead center position to its bottom dead center position, the refrigerant gas in the suction chamber 23*a* is forced into the associated suction port 24*a*, thus opening the suction flap 24*b* and entering the associated cylinder bore 22*a*. As the piston 31 moves from the bottom dead center position to the top dead center position, the refrigerant gas in the cylinder bore 22*a* is compressed to a predetermined pressure. The compressed refrigerant gas is forced into the associated discharge port 24*c*, thus opening the discharge flap 24*d* and entering the discharge chamber 23*b*.

As indicated by the arrow in FIG. 2, the refrigerant gas in the discharge chamber 23*b* flows toward the collection chamber 43 until it hits the second partition 45 and changes directions. The refrigerant gas then flows into the acceleration passage 49 and then to the collection compartment 43. When passing through the acceleration passage 49, the velocity of the refrigerant gas is increased. Thus, the refrigerant gas is swirled between the separation surface 48*e* and the peripheral surface 48*h* of the separation tube 48*c* by a strong force. During the swirling of the refrigerant gas, lubricating oil is separated from the refrigerant gas by centrifugation. Most of the separated lubricating oil collects on the separation wall 48*e*. The refrigerant gas, from which lubricating oil was separated, then passes through the discharge passage 47 and enters the muffler 46. Afterwards, the refrigerant gas is discharged into an external refrigerant circuit (not shown).

When the refrigerant gas hits the second partition 45, some of the lubricating oil separated from the refrigerant gas collects on the second partition 45. However, the lubricating oil collected on the second partition 45 is forced into the oil separator 48 by the flow of refrigerant gas headed toward the collection compartment 43. The lubricating oil from the second partition 45 then collects in the separation cell 48*a* together with the lubricating oil obtained by the swirling of the refrigerant gas.

When the load applied to the compressor is high, the high pressure in the suction chamber 23*a* acts on the diaphragm 38 of the control valve 35. This results in the valve body 36 closing the valve hole 37. Thus, the pressurizing passage 34 is closed and the flow of high pressure refrigerant gas from the discharge chamber 23*b* to the crank chamber 25 is impeded. In this state, the refrigerant gas in the crank chamber 25 is drawn into the suction chamber 23*a* through the relief passage 40. Accordingly, the difference between the pressure in the crank chamber 25 and the pressure in the cylinder bores 22 becomes small. This moves the swash plate 29 toward the maximum inclination position, as shown by the solid lines in FIG. 1. When the swash plate 29 is located at the maximum inclination position, the stroke of each piston 31 is increased and the displacement of the compressor becomes maximum.

When the load applied to the compressor is small, the low pressure in the suction chamber 23*a* acts on the diaphragm 38 and causes the valve body 36 to open the valve hole 37. Thus, high pressure refrigerant gas, the amount of which corresponds with the opened area of the valve hole 37, flows from the discharge chamber 23*b* to the crank chamber 25. Accordingly, the pressure in the crank chamber 25 increases. This increases the difference between the pressure in the crank chamber and the pressure in the cylinder bores 22. The pressure difference moves the swash plate 29 toward the minimum inclination position, as shown by the dotted lines in FIG. 1. As the swash plate 29 approaches the minimum inclination position, the stroke of each piston 31 becomes shorter and the displacement of the compressor becomes smaller.

In the variable displacement compressor, the load applied to the compressor (cooling load) adjusts the opened area of the control valve 35. This increases or decreases the pressure of the crank chamber 25 and alters the inclination of the swash plate 29.

When the control valve 35 opens and decreases the displacement of the compressor, the hot, pressurized refrigerant gas in the discharge chamber 23*b* is sent to the crank chamber 25. Thus, the temperature and pressure in the crank chamber 25 becomes high. However, with the control valve 35 in an opened state, the lubricating oil in the separation cell 48*a* is sent to the crank chamber 25 through the pressurizing passage 34 together with the refrigerant gas, which increases the pressure of the crank chamber 25. Accordingly, the crank chamber 25 is effectively supplied with lubrication oil even when the displacement of the compressor is small and the lubrication conditions are harsh. This sufficiently lubricates the surfaces between the pistons 31 and the associated shoes 32, the shoes 32 and the swash plate 29, and the moving parts of the radial bearings 27, the thrust bearings 33, 41, the lip seal 26*c*, and other parts.

The advantages of the first embodiment will now be described.

(1) The collection compartment 43 is located in the discharge chamber 23*b*. The inlet 34*a* of the pressurizing chamber 34 is connected with the collection compartment 43. Thus, the compressed refrigerant gas discharged into the discharge chamber 23*b* from the cylinder bores 22*a* by way of the associated discharge ports 24*c* enters the collection compartment 43 and is then sent to the crank chamber 25 through the pressurizing passage 34. Accordingly, lubricating oil included in the refrigerant gas is effectively sent to the crank chamber 25 under the harsh lubricating conditions that exist when the displacement of the compressor is small. This prevents insufficient lubrication.

(2) The control valve 35 is arranged in the pressurizing passage 34. Changes in the opened area of the control valve 35 adjust the amount of refrigerant gas supplied to the crank chamber 25 from the discharge chamber 23*b* and vary the displacement of the compressor. In other words, as the area of the valve hole 37, which is opened by the valve body 36, becomes larger in the control valve 35, the amount of refrigerant gas supplied to the crank chamber 25 increases. This decreases the inclination of the swash plate 29. Hence, as the displacement decreases, a larger amount of compressed refrigerant gas is sent into the crank chamber 25. Accordingly, a larger amount of lubricating oil is supplied to the crank chamber under the harsh lubricating conditions that exist when the displacement of the compressor is small. This sufficiently lubricates the moving parts in the crank chamber 25.

(3) The collection compartment 43 is located in the discharge chamber 23*b*, which is defined in the rear housing 23. Since the collection compartment 43 uses space that the discharge chamber 23*b* formerly occupied, the compressor need not be enlarged. Furthermore, the pressurizing passage 34 is incorporated in the compressor. This simplifies the assembly of the compressor in comparison with a compressor that has pipes arranged on its outer side to define a pressurizing passage.

(4) The first and second partitions 44, 45 define the collection compartment 43 in the discharge chamber 23*b*. Thus, the collection compartment 43 is defined in the discharge chamber 23*b* by a simple structure. Furthermore, in the collection compartment 43, one of the discharge ports 24*c* is located at the upstream side of the refrigerant gas flow, while the discharge passage 47 is communicated with the downstream side. Thus, the inlet 34*a* of the pressurizing passage 34 is separated from the inlet 47*a* of the discharge passage 47. Accordingly, the refrigerant gas discharged from the cylinder bores 22*a* and collected in the collection compartment 43 is effectively drawn into the pressurizing passage 34.

(5) The collection compartment 43 is provided with the oil separator 48. Thus, lubricating oil is separated from the refrigerant gas in the collection compartment 43. Opening of the control valve 35 effectively draws the lubricating oil, together with the compressed refrigerant gas, into the crank chamber 25 through the pressurizing passage 34. Accordingly, the moving parts in the crank chamber 25 are lubricated sufficiently under harsh lubricating conditions when the displacement of the compressor is small. Furthermore, this structure decreases the amount of lubricating oil sent to the external refrigerant circuit. Thus, a thick film of oil does not form on the heat conductive surface of downstream heat exchanging devices. This prevents degradation of the heat transfer efficiency of the downstream heat exchanging devices.

(6) The oil separator 48 is located in the collection compartment 43 of the discharge chamber 23*b* in the rear housing 23. Accordingly, in comparison to prior art compressors having an oil separator projecting from their cylinder blocks, the compressor of FIG. 1 is more compact.

(7) The compressed refrigerant gas heading toward the collection compartment 43 hits the second partition 45 and changes directions. This also separates the lubricating oil from the compressed refrigerant gas. Thus, together with the lubricating oil separated in the oil separator 48, this decreases the amount of lubricating oil included in the compressed refrigerant gas that is guided to the discharge passage 47.

(8) The accelerating passage 49 is located at the upstream side of the oil separator 48. Thus, the velocity of the compressed refrigerant gas moving toward the oil separator 48 is increased by the nozzle effect applied to the refrigerant gas when passing through the acceleration passage 49. The refrigerant gas is thus swirled strongly in the separation cell 48*a*. Accordingly, the oil separating efficiency of the oil separator 48 is enhanced. Furthermore, the oil is efficiently returned to the crank chamber 25 and the amount of oil sent to the external refrigerant circuit is decreased.

(9) The oil separator 48 includes the separation tube 48*c*. Accordingly, the flow of refrigerant gas in the separation cell 48*a* is regulated by the space between the separation surface 48*e* and the peripheral surface 48*h* of the separation tube 48*c*. This stabilizes the swirling of the refrigerant gas. Accordingly, centrifugation of the lubricating oil is performed effectively. This enhances the oil separating capability of the oil separator 48.

(10) The valve body 36 and the valve hole 37 of the control valve 35 constitute a restriction of the pressurizing passage 34. This limits the flow of refrigerant gas from the discharge chamber 23*b* to the crank chamber 25. Accordingly, the displacement of the compressor is controlled accurately.

(11) The restriction of the pressurizing passage 34 is constituted by the valve body 36 and the valve hole 37 of the control valve 35. Thus, a further restriction passage need not be provided. This simplifies the structure of the compressor.

(12) The compressed refrigerant gas is filtered by the filter 35*a* before entering the control valve 35. This prevents foreign material from entering the control valve 35. Thus, problems related to the opening and closing of the control valve 35 do not occur since foreign material does not get caught between the valve body 36 and the valve hole 37. This improves the durability of the control valve 35. Furthermore, foreign material is prevented from entering the crank chamber 25. Thus, foreign material does not get caught between moving parts in the crank chamber 25. This improves the durability of the compressor.

(13) The swash plate 29 is made of aluminum alloy. This provides a lighter swash plate in comparison with conventional swash plates made of steel. The combination of the aluminum alloy swash plate 29 and the structure for supplying lubricating oil to the crank chamber 25 sufficiently lubricates the contacting surfaces between the swash plate 29 and the shoes 32. Thus, it is not necessary to conduct the costly surface treatment on the swash plate 29. This reduces the costs of producing the compressor.

(14) The swash plate 29 is formed from aluminum alloy that includes hard particles such as eutectic or hypereutectic silicon. This improves the anti-wear property of the swash plate 29 and improves the durability of the compressor.

A second embodiment according to the present invention will now be described. The description will focus on parts differing from the first embodiment.

Figure 4:
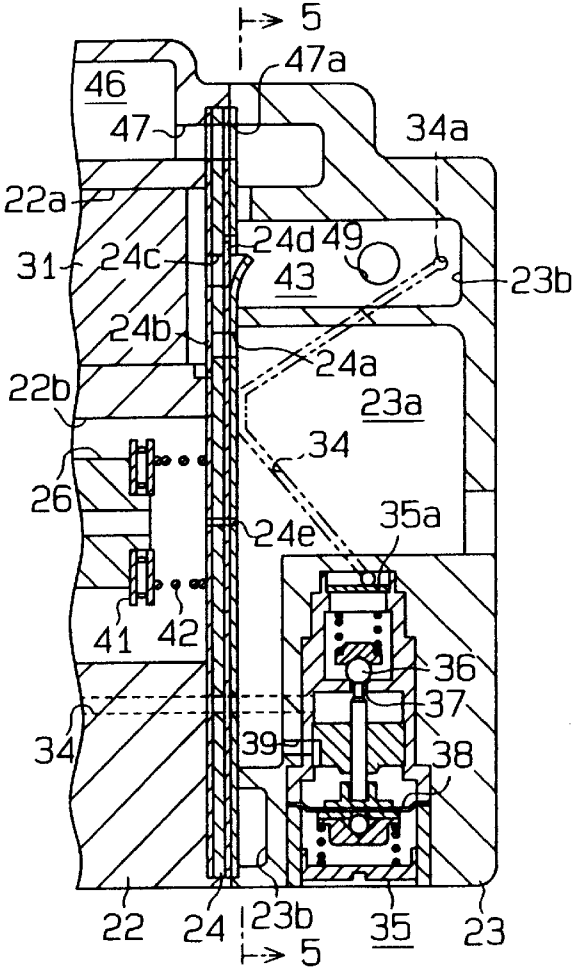
FIG. 4 is a partial cross-sectional view showing a second embodiment of a variable displacement compressor according to the present invention.
Figure 5:
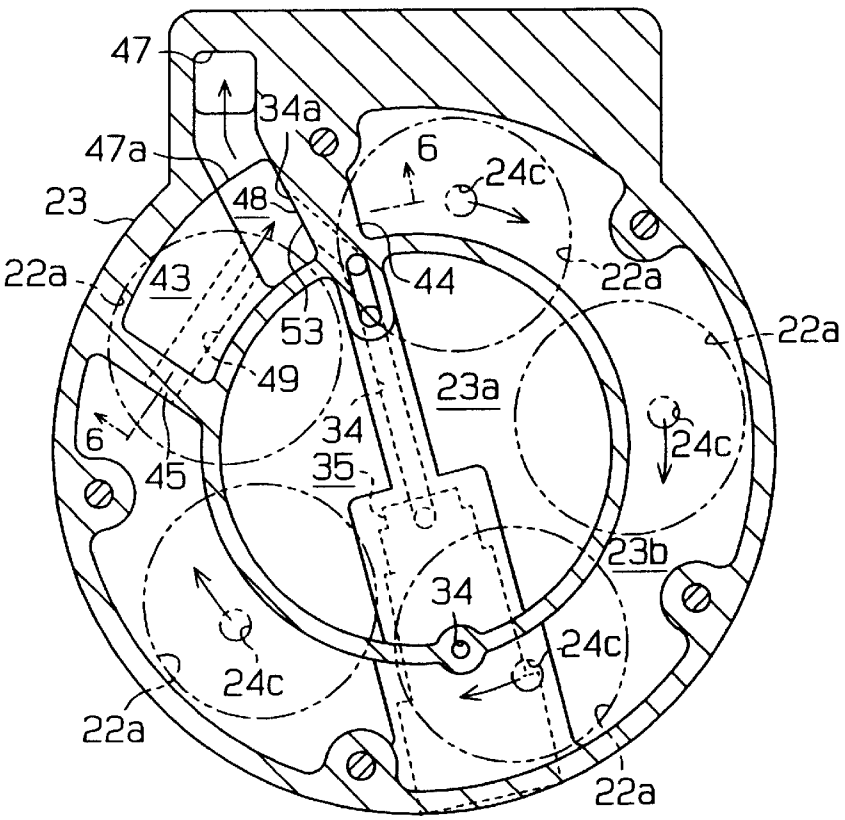
FIG. 5 is a cross-sectional view taken along line 5—5 in FIG. 4.
Figure 6:
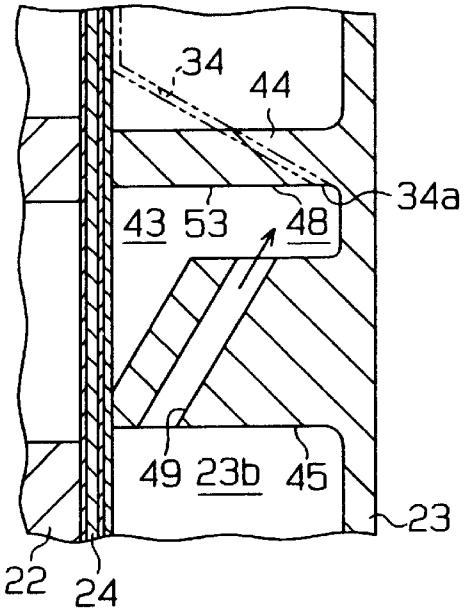
FIG. 6 is a partial cross-sectional view taken along line 6—6 in FIG. 5.

As shown in FIGS. 4 to 6, a first partition 44 and a second partition 45 define a collection compartment 43 in the discharge chamber 23*b*. A separation surface 53 facing toward the acceleration passage 49 is defined on the first partition 44 in the collection compartment 43. The separation surface 53 functions as an oil separator 48. The inlet 34*a* of the pressurizing passage 34 is connected with the collection compartment 43 at the separation surface 53.

Accordingly, the compressed refrigerant gas discharged into the discharge chamber 23*b* from the cylinder bores 22*a* through the associated discharge ports 24*c* is directed to the collection compartment 43, as indicated by the arrows in FIGS. 5 and 6. The refrigerant gas then flows into the discharge passage 47 and enters the muffler 46. In the collection compartment 43, the refrigerant gas from the acceleration passage 49 is blown against the separation surface 53 of the oil separator 48. When the refrigerant gas hits the separation surface 53, the lubricating oil is separated from the refrigerant gas and collected on the separation surface 53.

When the control valve 35 is opened and the displacement of the compressor becomes small, the oil collected on the surface of the separation surface 53 is forced through the pressurizing passage 34 toward the crank chamber 25 together with the refrigerant gas. This efficiently supplies the crank chamber 25 with lubricating oil and sufficiently lubricates the moving parts in the crank chamber 25.

Accordingly, the advantages of the first embodiment described in paragraphs (1) to (7) and paragraphs (10) to (14) are also obtained in the second embodiment. The advantages described below are further obtained in the second embodiment.

(15) The oil separator 48 has a simple structure. This simplifies the structure of the discharge chamber 23*b* and facilitates production of the compressor.

(16) The acceleration passage 49 is located at the upstream side of the oil separator 48. Thus, the velocity of the compressed refrigerant gas headed toward the oil separator 48 is increased. This blasts the refrigerant gas strongly against the separation surface 53. Accordingly, the oil separating efficiency of the oil separator 48 is enhanced. This further efficiently returns the lubricating oil to the crank chamber 25 and decreases the amount of oil sent to the external refrigerant circuit.

A third embodiment according to the present invention will now be described. The description will focus on parts differing from the first embodiment.

Figure 7:
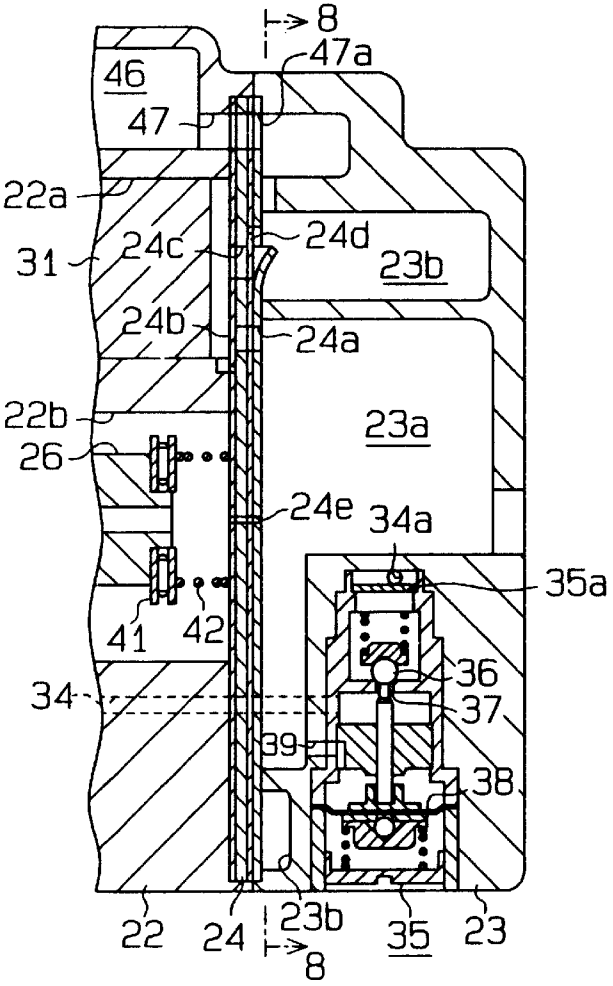
FIG. 7 is a partial cross-sectional view showing a third embodiment of a variable displacement compressor according to the present invention.
Figure 8:
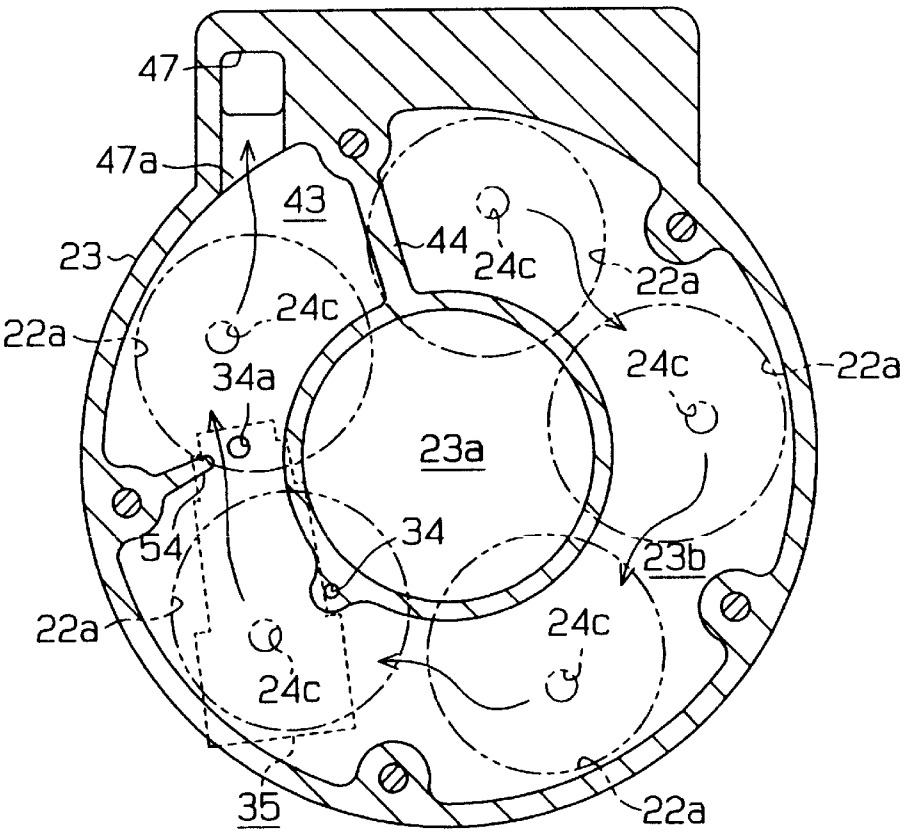
FIG. 8 is a cross-sectional view taken along line 8—8 in FIG. 7.

As shown in FIGS. 7 and 8, a first partition 44 and a guide wall 54, which serves as a second partition, define a collection compartment 43 in the discharge chamber 23. A passage is defined between the inner wall of the discharge chamber 23*b* and the guide wall 54. The flow of refrigerant gas from the discharge chamber 23*b* towards the collecting compartment 43 is restricted by the guide wall 54. The inlet 34*a* of the pressurizing passage 34 is located in the collection compartment 43 in the vicinity of the distal end of the guide wall 54.

In this embodiment, the compressed refrigerant gas in the cylinder bores 22*a* is discharged into the discharge chamber 23*b* through the associated discharge ports 24*c*. The discharged refrigerant gas enters the collection compartment 43, as indicated by the arrows in FIG. 8. The refrigerant gas then flows through the discharge passage 47 and enters the muffler 46. The guide wall 54 directs the refrigerant gas toward the inlet 34*a* of the pressurizing passage 34. Furthermore, lubricating oil separated from the refrigerant gas collects on the guide wall 54.

When the control valve 35 is opened and the displacement of the compressor becomes small, the lubricating oil collected on the surface of the guide wall 54 is forced toward the inlet 34*a* of the pressurizing passage 34 by the refrigerant gas flowing into the collection compartment 43. After entering the inlet 34*a*, the lubricating oil is sent to the crank chamber 25 together with the refrigerant gas. This efficiently supplies the crank chamber 25 with lubricating oil and sufficiently lubricates the moving parts in the crank chamber 25.

Accordingly, the advantages of the first embodiment described in paragraphs (1) to (3) and paragraphs (10) to (14) are also obtained in the third embodiment. The advantages described below are also obtained in the third embodiment.

(17) The guide wall 54 is located at the collection compartment 43 in the discharge chamber 23*b*. The guide wall 54 directs the refrigerant gas toward the inlet 34*a* of the pressurizing passage 34. This effectively sends lubricating oil toward the crank chamber 25 regardless of the absence of an oil separator 48 in the collection compartment 43. Thus, lubrication is enhanced by a more simple structure.

A fourth embodiment according to the present invention will now be described. The description will focus on parts differing from the first embodiment.

Figure 9:
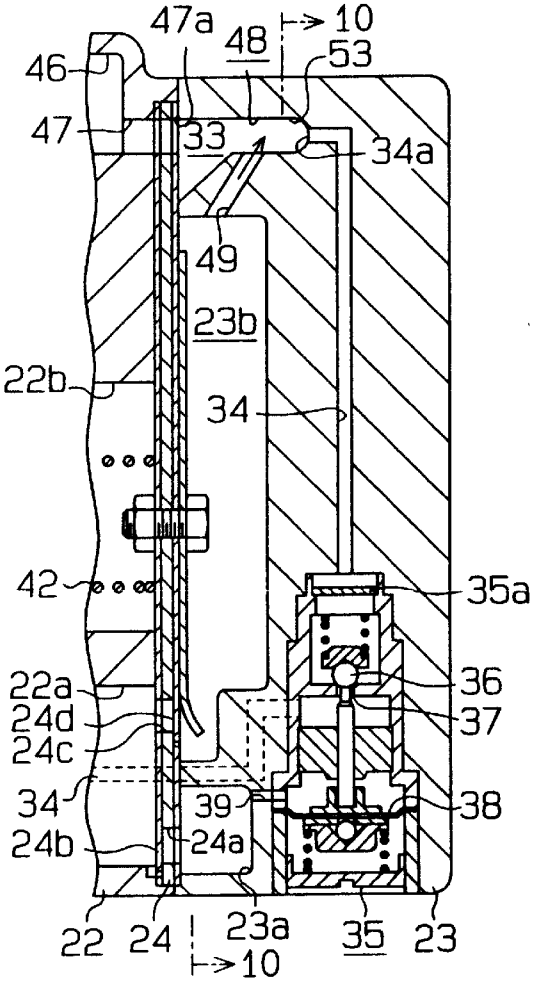
FIG. 9 is a partial cross-sectional view showing a fourth embodiment of a variable displacement compressor according to the present invention.
Figure 10:
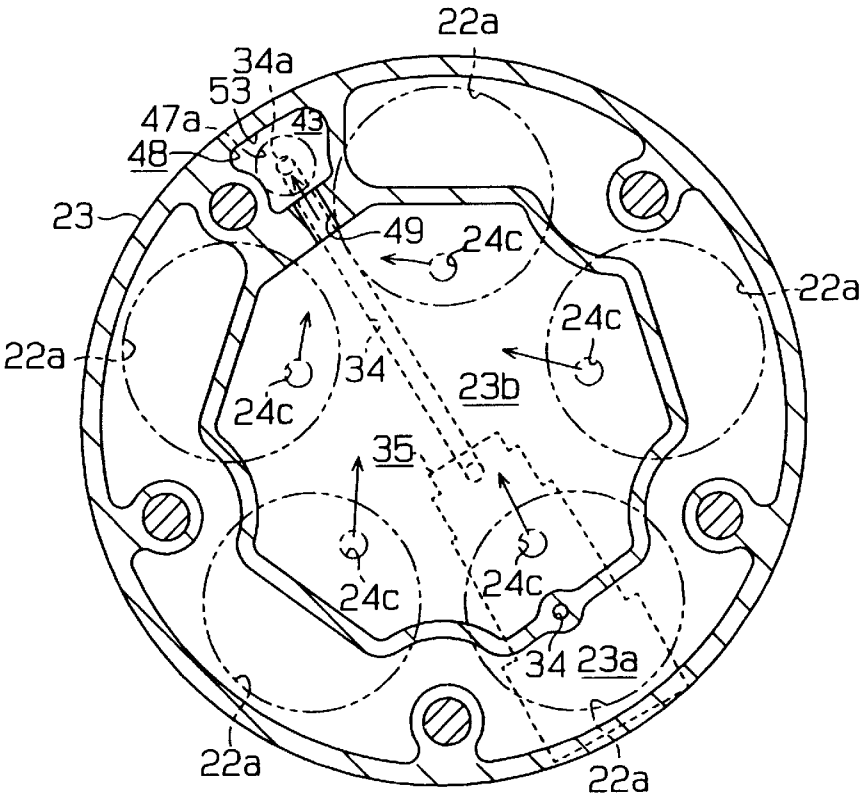
FIG. 10 is a cross-sectional view taken along line 10—10 in FIG. 9.

As shown in FIGS. 9 and 10, a generally annular suction chamber 23*a* is defined in the peripheral portion of the rear housing 23. A discharge chamber 23*b* is defined at the central portion of the rear housing 23. A collection compartment 43 is defined radially outward of the discharge chamber. An acceleration passage 49 connects the discharge chamber 23*b* with the collection compartment 43. The collection compartment 43 includes a separation surface 53 defined on a wall of the collection compartment 43 that faces the acceleration passage 49. The separation surface 53 constitutes an oil separator 48. The inlet 34*a* of the pressurizing passage 34 is located at the distal portion of the collection compartment 43.

The compressed refrigerant gas in the cylinder bores 22*a* is discharged into the discharge chamber 23*b* through the associated discharge ports 24*c*. The discharged refrigerant gas enters the collection compartment 43, as indicated by the arrows in FIG. 10. The refrigerant gas then flows into the discharge passage 47 and enters the muffler 46. In the collection compartment 43, the refrigerant gas is blown strongly against the separation surface 53 from the acceleration passage 49. As the refrigerant gas hits the separation surface 53, lubricating oil separates from the refrigerant gas and collects on the separation surface 53.

When the control valve 35 is opened and the displacement of the compressor is small, the lubricating oil collected on the separating wall 53 is forced into the pressurizing passage 34 and sent to the crank chamber 25. This efficiently supplies the crank chamber 25 with lubricating oil and sufficiently lubricates the moving parts in the crank chamber 25.

The advantages obtained in the second embodiment are also obtained in the fourth embodiment.

A fifth embodiment according to the present invention will now be described. The description will focus on parts differing from the first embodiment.

Figure 11:
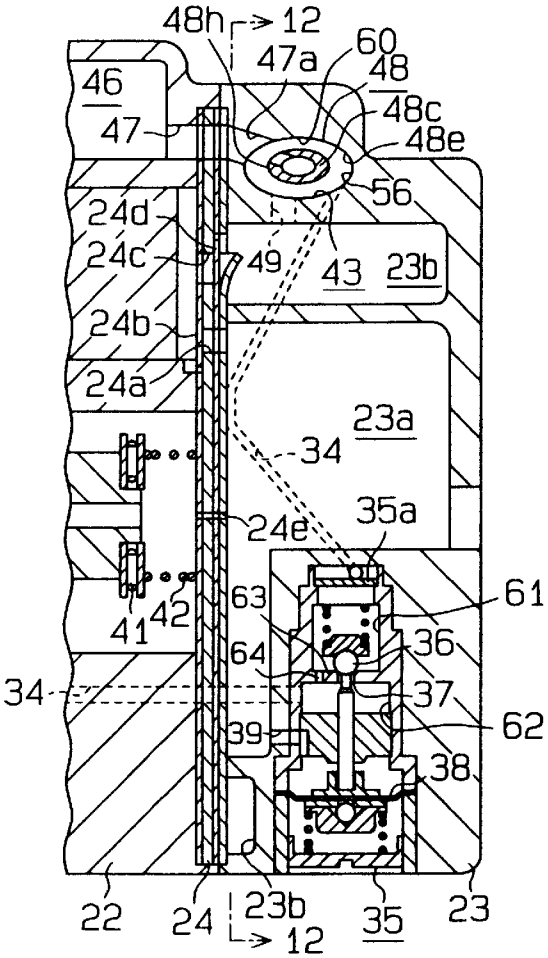
FIG. 11 is a partial cross-sectional view showing a fifth embodiment of a variable displacement compressor according to the present invention.
Figure 12:
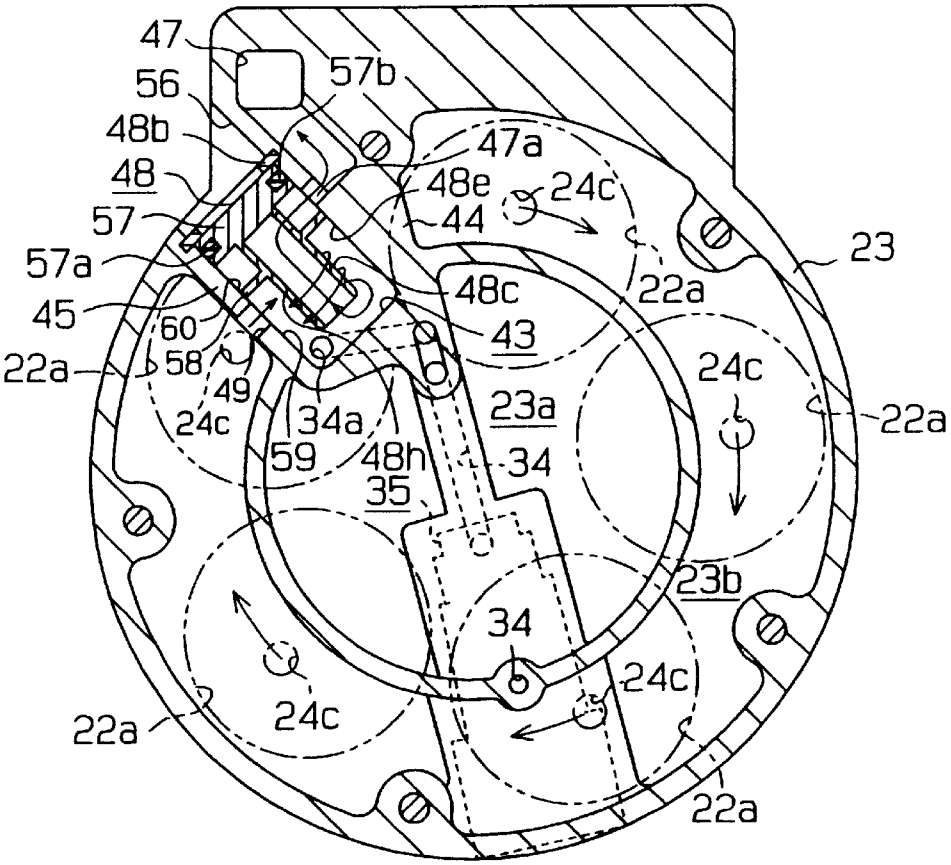
FIG. 12 is a cross-sectional view taken along line 12—12 in FIG. 11.

As shown in FIGS. 11 and 12, a first partition 44 and a second partition 45 define a collection compartment 43 in the discharge chamber 23*b*. The collection compartment 43 constitutes part of an accommodating bore 56 used to accommodate the separation tube 48*c* of the oil separator 48. The accommodating bore 56 has a circular cross-section. The axis of the accommodating bore 56 extends substantially in the radial direction of the rear housing 23. The separation tube 48*c* is arranged in the accommodating bore 56 with its axis extending in the radial direction of the rear housing 23. One end of the cylindrical separation tube 48*c* is covered by a flange 57. A partition flange 58 extends about the peripheral surface of the separation tube 48*c*. An annular groove 57*a* extends about the flange 57 to receive an O-ring 57*b*. The O-ring 57 prevents compressed refrigerant gas from leaking out of the compressor. The partition flange 58 partitions the accommodating bore 56 and defines a separation cell 59 and an outgoing cell 60. The inlet 34*a* of the pressurizing passage 34 is located in the separation cell 59. The refrigerant gas in the discharge chamber 23*b* is drawn into the separation cell 59 by way of an acceleration passage 49, which extends through the second partition 45. This strongly swirls the refrigerant gas between the separation surface 48 and the peripheral surface 48*h* of the separating tube 48*c* and separates the lubricating oil from the refrigerant gas. The compressed refrigerant gas, from which lubricating oil has been separated, flows through the separation tube 48*c* and enters the outgoing cell 60. The refrigerant gas then flows toward the inlet 47*a* of the discharge passage 47.

Figure 13:
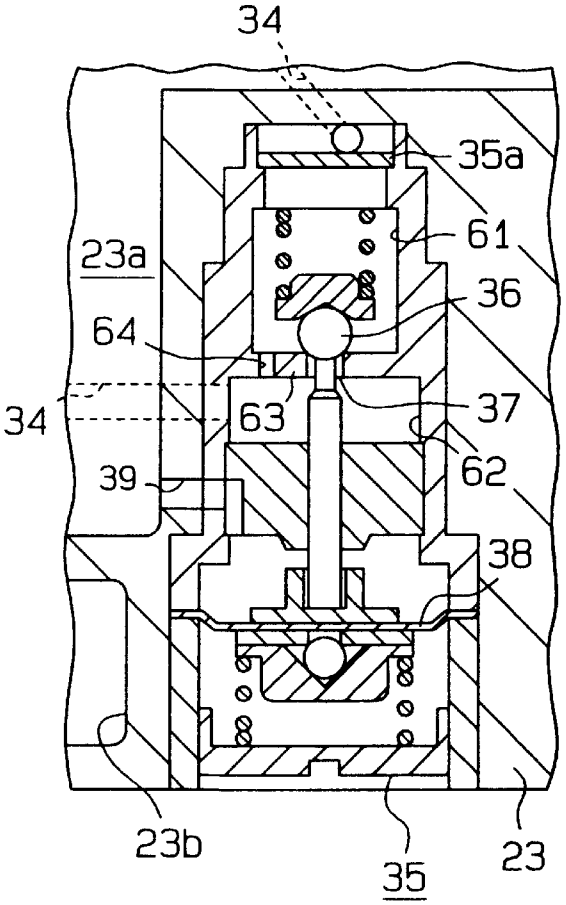
FIG. 13 is an enlarged cross-sectional view showing the displacement control valve is FIG. 11.

In this embodiment, the structure of the control valve 35 differs from that of the first embodiment. As shown in FIGS. 11 and 13, a valve body 36 is accommodated in a high pressure chamber, or first chamber 61. The high pressure chamber 61 is connected to the upstream side of the pressurizing passage 34 to receive high pressure refrigerant gas. A low pressure chamber, or second chamber 62 is connected to the high pressure chamber 61 though a valve hole 37. The low pressure chamber 62 is connected to the crank chamber 25 through the downstream side of the pressurizing passage 34. The pressure chambers 61, 62 are partitioned by a partition 63. A small hole 64 extends though the partition 63. The small hole 64 functions as a restriction passage. A certain amount of refrigerant gas constantly flows through the small hole 64 from the high pressure chamber 61 to the low pressure chamber 62. To facilitate illustration, the small hole 64 is enlarged and shown in an exaggerated manner in FIG. 13.

Accordingly, the advantages of the first embodiment described in paragraphs (1) to (9) and paragraphs (13) to (14) are also obtained in the fifth embodiment. The advantages described below are also obtained in the fifth embodiment.

(18) The oil separator 48 extends radially in the rear housing 23. In comparison to the compressor of the first embodiment, this arrangement of the oil separator 48 shortens the axial length of the compressor. Thus, the compressor of FIG. 12 is more compact, which facilitates installation in an engine compartment.

(19) The small hole 64 that constantly communicates the high pressure chamber 61 with the low pressure chamber 62 extends parallel to the valve hole 37. This keeps the interiors of the discharge chamber 23*b* and the crank chamber 25 connected even when the valve body 35 closes the valve hole 37. Accordingly, refrigerant gas including lubricating oil is always sent to the crank chamber 25 regardless of the opened area of the control valve 35. Thus, the moving parts in the crank chamber 25 are sufficiently lubricated.

(20) The restriction of the pressurizing passage 34 is constituted by the small hole 64. This simplifies the structure of the restriction and facilitates production of the compressor.

(21) The compressed refrigerant gas is filtered by the filter 35*a* before entering the control valve 35. This prevents foreign material from entering the control valve 35. Thus, problems related to the opening and closing of the control valve 35 do not occur since foreign material does not get caught between the valve body 36 and the valve hole 37. In addition, foreign material does not block the small hole 64. This guarantees the supply of lubricating oil when the control valve 35 is closed. Accordingly, the durability of the control valve 35 is enhanced. Furthermore, foreign material is prevented from entering the crank chamber 25. Thus, foreign material does not get caught between moving parts. This improves the durability of the compressor.

A sixth embodiment according to the present invention will now be described. The description will focus on parts differing from the above embodiments.

Figure 14:
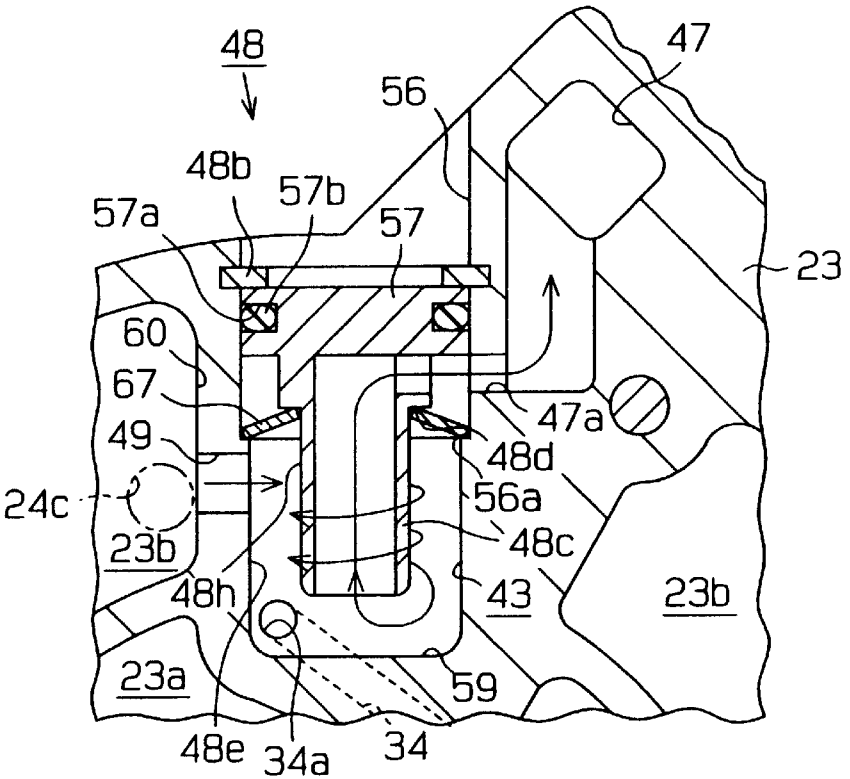
FIG. 14 is an enlarged, partial cross-sectional view showing an oil separator employed in a sixth embodiment according to the present invention.
Figure 15:
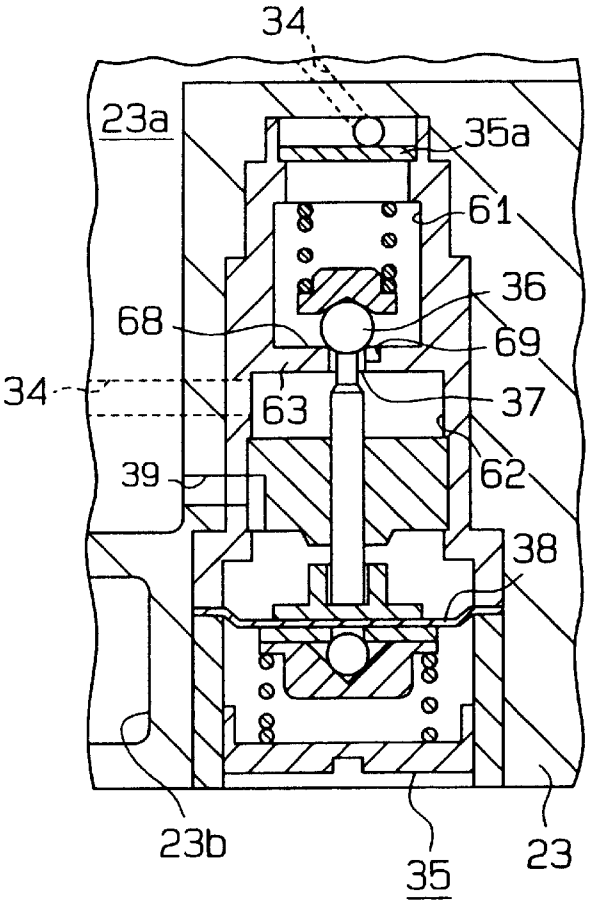
FIG. 15 is an enlarged, partial cross-sectional view showing an displacement control valve employed in the sixth embodiment.

As shown in FIGS. 14 and 15, the oil separator 48 and the control valve 35 differ from that of the fifth embodiment.

In the oil separator 48, a stepped portion 56*a* is defined on the wall of the accommodation bore 56. The separation tube 48*c* also has a stepped portion 48*d* defined on its peripheral surface 48*h*. An annular washer 67 is arranged between the stepped portions 48*d* and 56*a*. With the separation tube 48*c* arranged in the accommodation bore 56, a separation cell 59 and an outgoing cell 60 are defined by the washer 67.

The control valve 35 has a valve seat 68, which surrounds the valve hole 37 and faces the valve body 36. A notch 69 is provided in the valve seat 68. The notch 69 constitutes a leakage passage. A certain amount of compressed refrigerant gas always flows from the high pressure chamber 61 to the low pressure chamber 62 through the notch 69. Thus, the notch 69 permits the leakage of the refrigerant gas even when the valve body 36 is fully closed. To facilitate illustration, the notch 69 is enlarged and shown in an exaggerated manner.

The advantages of the sixth embodiment are the same as the fifth embodiment. The advantages described below are also obtained in the sixth embodiment.

(22) The restriction of the pressurizing passage 34 is constituted by the notch 69 in the valve seat 68. The notch 69 permits the flow of refrigerant gas from the high pressure chamber 61 to the low pressure chamber 62. This simplifies the structure of the restriction in the pressurizing passage 34 and facilitates manufacturing of the compressor.

(23) In the oil separator 48, the washer 67 partitions the separation cell 59 and the outgoing cell 60. Thus, a partition flange need not be provided on the peripheral surface 48*h* of the separation tube 48. Furthermore, the washer 67 does not require accurate dimensions in comparison with a partition flange that seals the space between separation tube and the wall of the accommodating bore 56 to define the separation cell 59 and the outgoing cell 60. Hence, accurate machining of the washer 67 is not necessary. Accordingly, the machining of the oil separator 48 is facilitated. This, in turn, facilitates the production of the compressor.

(24) The contact between the outer rim of the washer 67 and the stepped portion 48d and between the inner rim of the washer 67 and the stepped portion 56*a* seals the separation cell 59 and the outgoing cell 60 from one another. This structure further enhances the sealing between the separation cell 59 and the outgoing cell 60. Furthermore, when fixing the separation tube 48*c* to the accommodation bore 56 with the snap ring 48*b*, dimensional margins provided for the separation tube 48*c* in the axial direction are compensated for by the elastic deformation of the washer 67.

A seventh embodiment according to the present invention will now be described. The description will focus on parts differing from the above embodiments.

Figure 16:
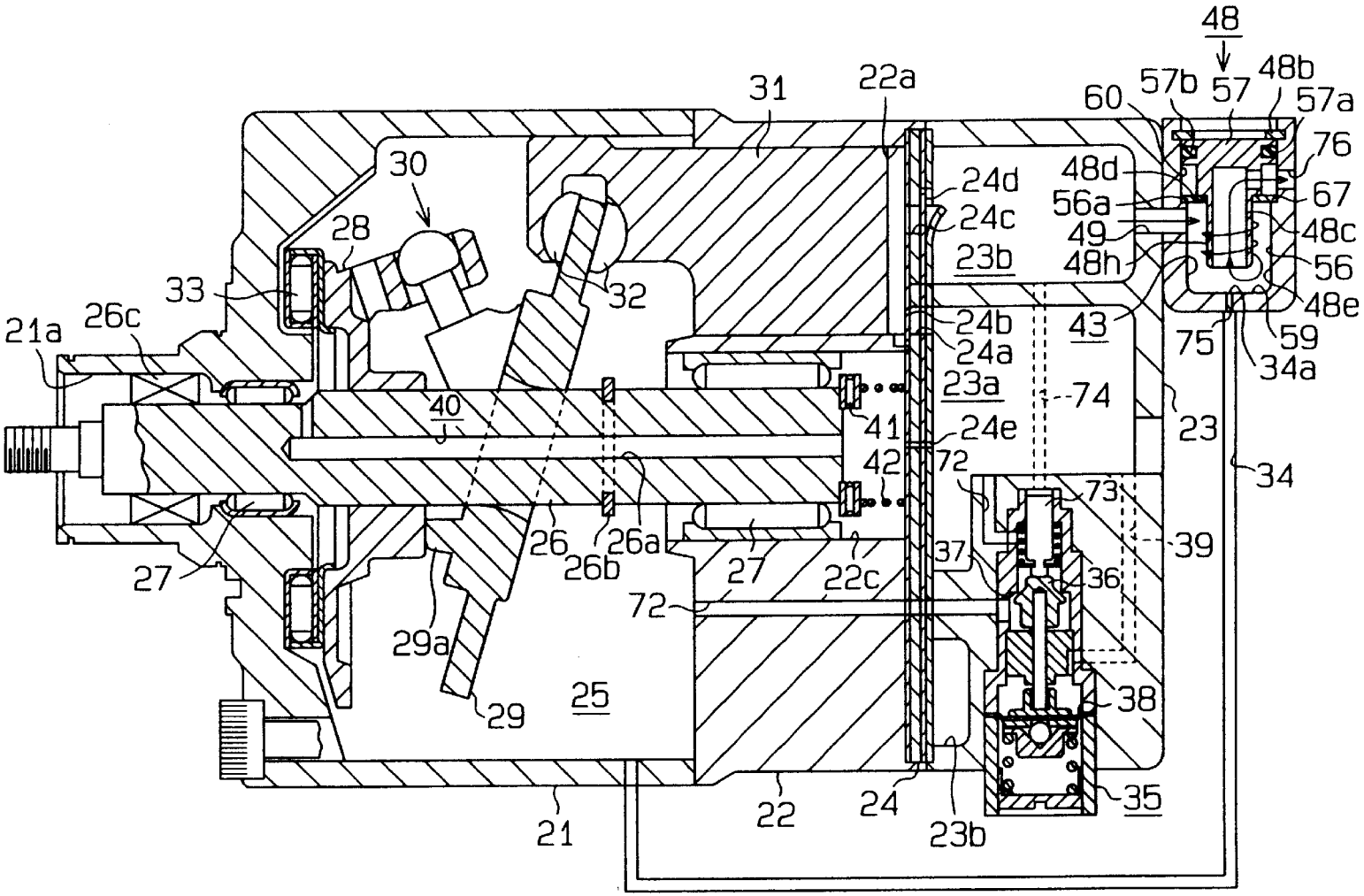
FIG. 16 is a cross-sectional view showing a seventh embodiment of a variable displacement compressor according to the present invention.

As shown in FIG. 16, the structure of the control valve differs from the above embodiments. Furthermore, the oil separator 48 is located on the outer side of the compressor.

The crank chamber 25 and the suction chamber 23*a* are connected to each other by two relief passages 40, 72. Like the first embodiment, the first relief passage 40 is constituted by the conduit 26*a*, the central bore 22*b* of the cylinder block 22, and the pressure releasing hole 24*e* provided in the center of the valve plate 24. The second relief passage 72 extends though the cylinder block 22, the valve plate 24, and the rear housing 23.

The control valve 35 is arranged in the second relief passage 72. The control valve 35 has a valve body 36, a valve hole 37, a diaphragm 38 for adjusting the opened area of the valve hole 37, and a pressure sensing member 73. The area of the valve hole 37 opened by the valve body 37 is adjusted in accordance with the suction pressure, which is communicated to the diaphragm 38 through a first pressure passage 39, and the discharge pressure, which is communicated to the pressure sensing member 73 through a second pressure passage 74.

Adjustment of the opened area of the control valve 35 changes the amount of refrigerant gas released into the suction chamber 23*a* from the crank chamber 25 through the second relief passage 72. This adjusts the difference between the pressure in the crank chamber 25 acting on the pistons 31 and the pressure in the cylinder bores 22*a* acting on the associated pistons 31. The pressure difference alters the inclination of the swash plate 29. This, in turn, alters the stroke of the pistons 31 and varies the displacement of the compressor.

The oil separator 48 is secured to the rear end surface of the rear housing 23 outside the compressor. The oil separator 48 has a stepped portion 56*a* defined on the surface of the accommodating bore 56. The separation tube 48*c* has a stepped portion 48*d* defined on its peripheral surface 48*h*. An annular, flat washer 67 is arranged between the stepped portions 48d and 56*a*. With the separation tube 48*c* arranged in the accommodation bore 56, a separation cell 59 and an outgoing cell 60 are defined by the washer 67.

An acceleration passage 49 connects the discharge chamber 23*b* and the separation cell 59. The oil separator 48 functions as a collection compartment 43 for collecting the refrigerant gas discharged from the discharge ports 24*c*. A small hole 75 serves as an inlet 34*a* of the pressurizing passage 34 that connects the discharge chamber 23*b* and the crank chamber 25. The small hole 75 also functions as a restriction in the pressurizing passage 34. The outgoing cell 60 has an outlet 76, which is connected to an external refrigerant circuit (not shown).

A certain amount of the high pressure refrigerant gas in the separation cell 59 of the oil separator 48 is constantly supplied to the crank chamber 25 through the pressurizing passage 34. This maintains the pressure of the crank chamber 25 at a value higher than a predetermined value. Thus, when the control valve 35 alters the opened area of the second relief passage 72, the inclination of the swash plate 29 is readily altered. This improves the response of the compressor when altering its displacement. Furthermore, lubricating oil separated from the refrigerant gas by the oil separator 48 is always supplied to the crank chamber 25 through the pressurizing passage 34. This sufficiently lubricates the moving parts in the crank chamber 25.

The operation of the seventh embodiment will now be described.

When the temperature in the passenger compartment is high, the load applied to the compressor is large. In this state, the difference between the pressure in the cylinder bores 22*a* and the pressure in the crank chamber 25 is small. The small pressure difference moves the swash plate 29 to its maximum inclination position. This increases the stroke of each piston 31 and causes the displacement of the compressor to become large. The pressure in the discharge chamber 23*b* is high in this state. The high pressure of the discharge chamber 23*b* is communicated to the pressure sensing member 73 of the control valve 35 through the second pressure passage 74. Additionally, high suction pressure is communicated to the diaphragm 38 of the control valve 35 through the first pressure passage 39. Thus, the pressure sensing member 73 and the diaphragm 38 are urged in a direction that causes the valve body 36 to open the valve hole 37. In other words, the second relief passage 72 is opened and the refrigerant gas in the crank chamber 25 is released into the suction chamber 23*a* through the second relief passage 72. This suppresses undesirable pressure increases caused by blowby gas from the crank chamber 25. Thus, the displacement of the compressor is maintained at a high level.

A temperature decrease in the passenger compartment decreases the load applied to the compressor. This decreases the pressure in the suction chamber 23*a*. The low suction pressure is communicated to the diaphragm 38 of the control valve 35 through the first pressure passage 39. This urges the diaphragm 38 in a direction that causes the valve body 36 to close the valve hole 37 in accordance with the decrease in the suction pressure. As the valve body 36 moves toward the valve hole 37, the opened area of the second relief passage 72 in the control valve 35 decreases. This reduces the amount of refrigerant gas released into the suction chamber 23*a* from the crank chamber 25 through the second relief passage 72. As a result, the pressure in the crank chamber 25 increases. This increases the difference between the pressure in the crank chamber 25 and the pressure in the cylinder bores 22*a*. The pressure difference moves the swash plate 29 toward the minimum inclination position. This decreases the stroke of the pistons 31 and decreases the displacement of the compressor. The pressure in the discharge chamber 23*b* is also decreased.

As the temperature in the passenger compartment further decreases and the load applied to the compressor becomes minimal, the pressure in the suction chamber 23*a* and the pressure in the discharge chamber 23*b* further decreases. Thus, the pressure sensing member 73 and the diaphragm 38 are urged in a direction that causes the valve body 36 to close the valve hole 37. In this state, the second relief passage 72 is closed and the refrigerant gas released from the crank chamber 25 is reduced significantly. The high pressure refrigerant gas supplied to the crank chamber 25 from the discharge chamber 23*b* through the pressurizing passage 34 increases the difference between the pressure in the crank chamber 25 and the pressure in the cylinder bores 22*a*. The pressure difference moves the swash plate 29 to the minimum inclination position. This further decreases the stroke of the pistons 31 and causes the displacement of the compressor to become minimum.

When the compressor operates with its displacement maintained at a certain level and the temperature in the passenger compartment increases, the load applied to the compressor increases. This increases the pressure in the suction chamber 23*a*. In this state, the increased suction pressure is communicated to the diaphragm 38 through the first pressure passage 39. This urges the diaphragm 38 in a direction causing the valve body 36 to open the valve hole 37. Thus, the opened area of the second relief passage 72 in the control valve 35 increases. This, in turn, increases the amount of refrigerant gas released into the suction chamber 23*a* from the crank chamber 25 through the second relief passage 72. As a result, the pressure in the crank chamber 25 decreases. Hence, the difference between the pressure in the crank chamber 25 and the pressure in the cylinder bores 22*a* decreases. The pressure difference moves the swash plate 29 toward the maximum inclination position. This increases the stroke of the pistons 31 and increases the displacement of the compressor. The pressure in the discharge chamber 23*b* is also increased.

As the temperature in the passenger compartment and, therefore, the load applied to the compressor further increases, the pressure in the suction chamber 23*a* and the pressure in the discharge chamber 23*b* further increases. Thus, the pressure sensing member 73 and the diaphragm 38 are urged in a direction that causes the valve body 36 to open the valve hole 37. In this state, the second relief passage 72 is opened and the refrigerant gas released into the suction chamber 23*a* from the crank chamber 25 through the second relief passage 72 becomes maximal. This decreases the difference between the pressure in the crank chamber 25 and the pressure in the cylinder bores 22*a*. The pressure difference moves the swash plate 29 to the maximum inclination position. This further increases the stroke of the pistons 31 and causes the displacement of the compressor to become maximal.

Accordingly, the advantages of the above embodiments described in paragraphs (8), (9), (13), (14), and (23) are also obtained in the seventh embodiment. The advantages described below are also obtained in the seventh embodiment.

(25) The collection compartment 43 is defined in the oil separator 48. The inlet 34*a* of the pressurizing passage 34 is located in the collection compartment 43. Thus, the compressed refrigerant gas discharged from the discharge ports 24*c* of the cylinder bores 22*a* is sent into the discharge chamber 23*b*, the oil separator 48, and then to the collection compartment 43. Afterwards, the refrigerant gas is sent to the crank chamber 25 through the pressurizing passage 34. Accordingly, refrigerant gas including lubricating oil is effectively drawn into the crank chamber 25. This prevents insufficient lubrication.

(26) The control valve 35 is located in the second relief passage 72. Thus, refrigerant gas including lubricating oil is always supplied to the crank chamber 25 through the pressurizing passage 34. This sufficiently lubricates the moving parts in the crank chamber 25.

(27) The oil separator 48 is arranged in a continuous manner with the discharge chamber 23*b*. Thus, the oil separator 48 separates lubricating oil from the refrigerant gas, which is collected in the collection compartment 48 of the oil separator 48. The separated lubricating oil is effectively drawn into the crank chamber 25 together with refrigerant gas through the pressurizing passage 34. This sufficiently lubricates the moving parts in the crank chamber 25 under the harsh lubricating conditions that exist when the displacement of the compressor is small. Furthermore, the amount of lubricating oil sent to the external refrigerant circuit is reduced. This prevents the formation of thick oil films on the heat conductive surfaces of downstream heat exchanging devices and thus prevents degradation of the cooling efficiency of the cooling circuit.

(28) The small hole 75 of the oil separator 48 functions as the restriction of the pressurizing passage 34. This limits the quantity of refrigerant gas sent to the crank chamber 25 from the separation cell 59 of the oil separator 48. Accordingly, the displacement of the compressor is controlled accurately.

(29) The cooperation between the washer 67 and the stepped portions 48*d*, 56*a* seals the space between the separation cell 59 and the outgoing cell 60. This further enhances the sealing between the separation cell 59 and the outgoing cell 60.

An eighth embodiment according to the present invention will now be described. The description will focus on parts differing from the first embodiments.

Figure 17:
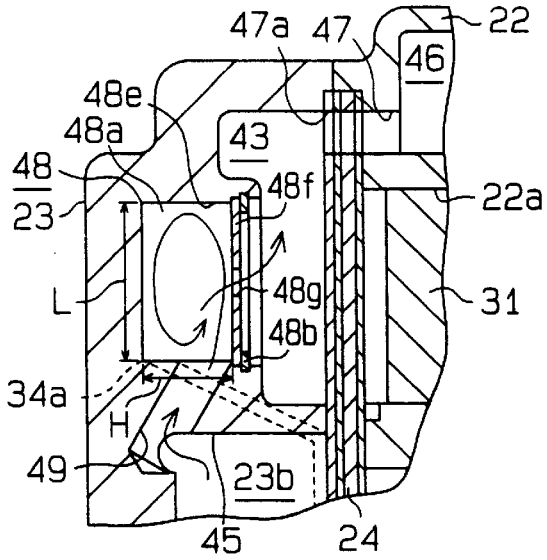
FIG. 17 is an enlarged, partial cross-sectional view showing an oil separator employed in an eighth embodiment according to the present invention.

As shown in FIG. 17, in this embodiment, the oil separator 48 does not include the separation tube 48*c*. A partition plate 48*f* is fixed to the wall of the cylindrical separation cell 48*a* by a snap ring 48*b*. A communication hole 48*g* extends through the center of the partition plate 48*f* to connect the separation chamber 48 to the discharge passage 47 by way of the collection compartment 43. Before entering the collection compartment 43, the refrigerant gas is swirled along the separation surface 48*e* in the separation cell 48*a* of the separator 48. The lubricating oil included in the refrigerant gas is separated by centrifugation and collected on the separation surface 48*e*. The refrigerant gas, from which lubricating oil has been separated, is discharged toward the discharge passage 47 from the separation cell 48*a*.

The ability to separate lubricating oil would be decreased in an oil separator 48 like that of the first embodiment, in which the axial length H of the cylindrical separation surface 48*e* is longer than the diameter L of the separation surface 48*e*, if the partition plate 48*f* is employed in lieu of the separation tube 48*c*.

Accordingly, in this embodiment, the axial length H of the separation surface 48*e* is shorter than the diameter L of the separation surface 48*e*. This stabilizes the swirling of the refrigerant gas in the separation cell 48*a* even without the separation tube 48*c*. Thus, centrifugation of lubricating oil is performed effectively.

Figure 18A:
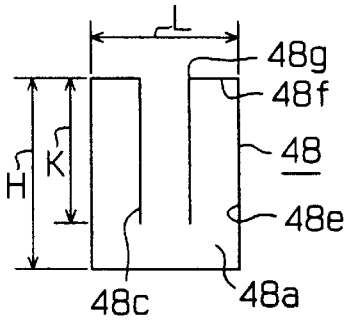
FIG. 18(*a*) is a diagram showing the conditions for conducting an experiment.
Figure 18B:
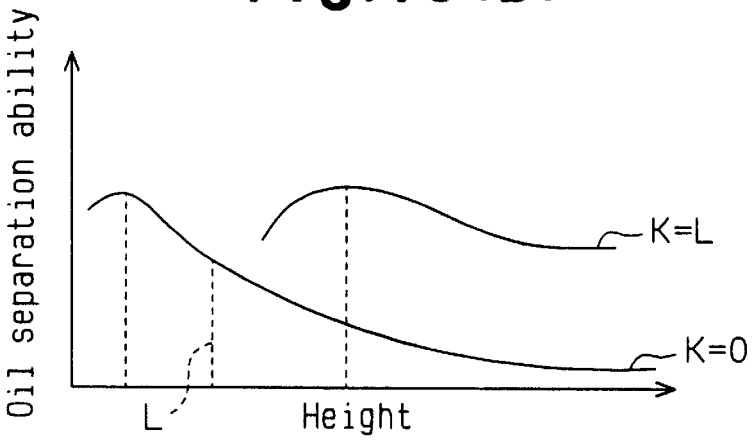

The inventors has conducted experiments to confirm the oil separation ability of the oil separator 48. In the experiment, the oil separator 48 of the first embodiment (separation tube 48*c* employed, axial length H longer than diameter L) was compared with that of the second embodiment (no separation tube 48*c*). As shown in FIG. 18(*a*), the separation surfaces 48*e* of both oil separators 48 had the same diameter L. The axial length K of the separation tube 48*c* of the oil separator 48 employed in the first embodiment was equal to the diameter L of the separation tube 48*c*. In the experiment, the axial length H of the separation surfaces 48*e* of both oil separators 48 were altered to measure changes in the oil separation ability.

As apparent from the graph of FIG. 18(*b*), the oil separator 48, which does not use the separation tube (K=0), obtains substantially the same oil separation ability as the oil separator 48 of the first embodiment when the axial length H is shorter than the diameter L.

Accordingly, the advantages of the above embodiments described in paragraphs (1) to (8) and paragraphs (10) to (14) are also obtained in the eighth embodiment. The advantages described below are also obtained in the eighth embodiment.

(30) The axial length H of the separation surface 48*e* in the oil separator 48 is shorter than the diameter L of the oil separator 48. As shown in FIG. 18(*b*), this results in the same oil separation ability as the oil separator 48 of the first embodiment with a shorter axial length H. The shorter axial length H of the separation surface 48*e* results in a more compact oil separator 48. This facilitates the installation of the oil separator 48.

(31) Since a separation tube 48*c* is not used, the structure of the oil separator 48 is simple. This facilitates the production of the oil separator 48 and decreases the production cost of the compressor.

A ninth embodiment according to the present invention will now be described. The description will focus on parts differing from the eighth embodiment.

Figure 19:
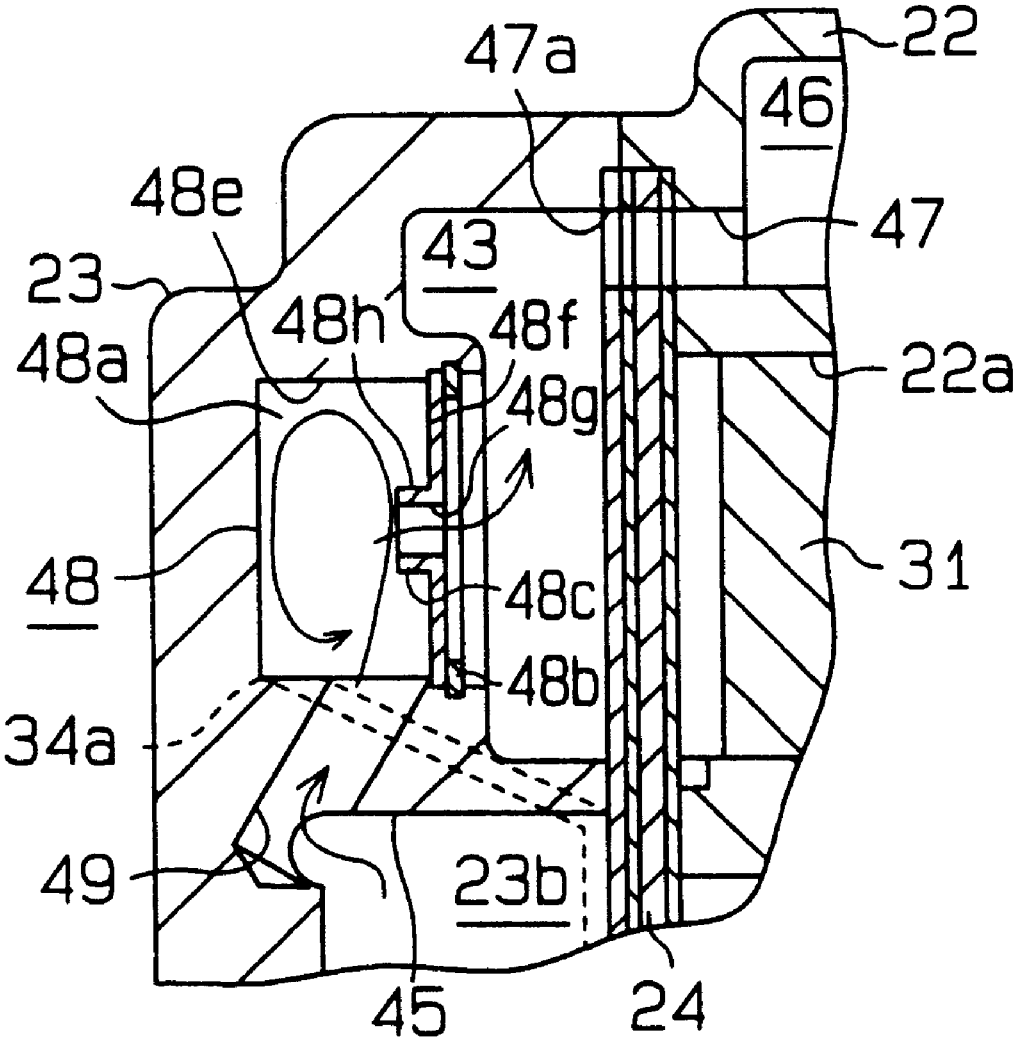
FIG. 19 is an enlarged, partial cross-sectional view showing an oil separator employed in a ninth embodiment according to the present invention.

As shown in FIG. 19, the oil separator 48 of this embodiment includes a separation cell 48*a*. A separation tube 48*c* having an axial length H shorter than the separation surface 48*e* is arranged in the separation cell 48*a*. The employment of the separation tube 48*c* enhances the oil separation ability of the oil separator 48 in comparison with the oil separator 48 of the eighth embodiment. Since the axial length of the separation tube 48*c* is shorter than that of the separation surface 48*e*, the separation tube 48 may easily be formed. For example, the separation tube 48 may be formed by simply bending the partition plate 48*f* about the communication hole 48*g*. Accordingly, the separation tube 48*c* may be employed without complicating the structure of the oil separator 48.

It should be apparent to those skilled in the art that the present invention may be embodied in many other specific forms without departing from the spirit or scope of the invention. Particularly, it should be understood that the invention may be embodied in the following forms.

In the first, second, and third embodiments, more than two discharge ports 24*c*, which are connected with the discharge chamber 23*b*, may be provided for each cylinder bore 22*a*.

In the fourth embodiment, the oil separator 48 may be replaced by that of the first embodiment. This enhances the oil separation ability of the oil separator 48.

In the sixth embodiment, like the embodiment of FIG. 15, the control valve 35 may have a notch on the valve body 36 at a portion facing the valve seat 68 to permit the leakage of refrigerant gas when the valve body 36 is arranged at a position that substantially closes the valve hole 37.

In the sixth embodiment, the opposing surface of either the valve body 36 or the valve seat 37 may be roughened to permit the leakage of refrigerant gas when the valve body 36 is arranged at a position that substantially closes the valve hole 37.

In each of the above embodiments, the swash plate 29 may include hard particles other than eutectic or hypereutectic silicon. For example, the swash plate 29 may be made of an aluminum alloy that includes a ceramic such as silicon carbide, silicon nitride, chromium carbide, boron nitride, tungsten carbide, boron carbide, and titanium carbide.

The present invention may be embodied in a variable displacement compressor that employs a wobble plate. In this case, the advantages of the above embodiments are also obtained.

The present invention may be embodied in a clutchless type variable displacement compressor that is always operably connected to an external drive source such as an engine. In this case, the lubrication of the moving parts in the crank chamber 25 is facilitated when the compressor operates continuously in a minimum displacement state.

Therefore, the present examples and embodiments are to be considered as illustrative and not restrictive and the invention is not to be limited to the details given herein, but may be modified within the scope and equivalence of the appended claims.

What is claimed is:

1. A variable displacement type compressor having a crank chamber defined in a housing, a drive shaft rotatably supported by a housing, a plurality of cylinder bores defined in a cylinder block to surround the drive shaft, a piston that reciprocates within the associated cylinder bore, a supply passage for communicating a discharge area that includes a discharge chamber within the housing to the crank chamber, a discharge port associated with each cylinder bore, and a cam plate tiltably supported on the drive shaft, wherein, when each piston reciprocates, a refrigerant gas is drawn into the associated cylinder bore from a suction chamber and discharged from the associated cylinder bore to the discharge chamber via the associated discharge port, and wherein the amount of gas discharged from the bores is controlled by varying the inclination of the cam plate, the compressor comprising:

a collection compartment located in the discharge area, the collection compartment receiving the refrigerant gas discharged from the discharge ports;

an inlet of the supply passage open to the collection compartment; and an oil separator located in the collection compartment for recovering oil from the refrigerant gas and introducing the recovered oil to the crank chamber via the supply passage.

2. The compressor according to claim 1 further comprising a control valve provided in the supply passage for adjusting an opening amount of the supply passage, wherein the control valve varies the amount of the refrigerant gas supplied from the discharge chamber to the crank chamber via the supply passage in accordance with the adjustment of the opening amount of the supply passage to alter a pressure difference between the pressure in the crank chamber and the pressure in the cylinder bores, so that the inclination of the cam plate varies in accordance with the pressure difference.

3. The compressor according to claim 1 further comprising a relief passage for connecting the crank chamber to the suction chamber, wherein the control valve varies the amount of refrigerant gas delivered from the crank chamber to the suction chamber via the relief passage in accordance with the adjustment of the opening amount of the supply passage to alter a pressure difference between the pressure in the crank chamber and the pressure in the cylinder bores, so that the inclination of the cam plate varies in accordance with the pressure difference.

4. The compressor according to claim 1, wherein the collection compartment is located within the discharge chamber.

5. The compressor according to claim 1, wherein the housing has an outer peripheral section in which an annular discharge chamber is formed, wherein the discharge chamber has first and second partitions for defining the collection compartment therein, wherein the collection compartment has a discharge passage for discharging the refrigerant gas from the compressor, the discharge passage having an inlet adjacent to the first partition, wherein the discharge passage inlet is open to the collection compartment, and wherein at least one of the discharge ports opens to the collection compartment, and the remaining discharge ports open to the discharge chamber.

6. The compressor according to claim 5, wherein the second partition guides the refrigerant gas toward the inlet of the supply passage and defines a passage for introducing the refrigerant gas from the discharge chamber to the collection compartment.

7. The compressor according to claim 1 further comprising an acceleration passage for accelerating the flow of the refrigerant gas, wherein the acceleration passage restricts the flow of gas upstream of the oil separator.

8. The compressor according to claim 2 further comprising a restriction provided in the supply passage to limit the flow of gas in the supply passage.

9. The compressor according to claim 8, wherein the control valve includes:

a valve hole connected to the supply passage; and a valve body for adjusting an opening amount of the supply passage;

wherein the valve hole and the valve body serve as the restriction in the supply passage.

10. The compressor according to claim 2, wherein the control valve includes:

a valve hole connected to the supply passage;

a valve body for adjusting an opening amount of the supply passage; and a fixed restriction passage located in parallel with the refrigerant gas flow through the valve hole and connected to the supply passage.

11. The compressor according to claim 10, wherein the control valve is located in the supply passage, and wherein the control valve includes:

a first chamber connected to the discharge chambers;

a second chamber connected to the crank chamber; and a partition wall for defining the first and second chambers;

wherein the valve hole and the fixed restriction passage are formed in the partition wall.

12. The compressor according to claim 11, wherein the valve hole includes a leakage passage connected to the supply passage to permit the valve to leak, the leakage passage being opened even when the valve body is fully closed.

13. The compressor according to claim 9, wherein the control valve has a filter for filtering the refrigerant gas entering the control valve through the supply passage.

14. A variable displacement type compressor having a crank chamber defined in a housing, a drive shaft rotatably supported by a housing, a plurality of cylinder bores defined in a cylinder block to surround the drive shaft, a piston that reciprocates within the associated cylinder bore, a supply passage for connecting a discharge chamber, which is defined within the housing to the crank chamber, a discharge port associated with each cylinder bore, and a cam plate tiltably supported on the drive shaft, wherein, when each piston reciprocates a refrigerant gas is drawn into the associated cylinder bore from a suction chamber and discharged from the associated cylinder bore to the discharge chamber via the associated discharge port, and wherein the amount of gas discharged from the bores is controlled by varying the inclination of the cam plate, the compressor comprising:

a collection compartment for receiving the refrigerant gas discharged from the cylinder bores, herein an inlet of the supply passage opens to the collection compartment; and an oil separator located in the collection compartment for recovering oil from the refrigerant gas and introducing the recovered oil to the supply passage, the oil separator including a cylindrical chamber configuration having an inner wall for turning the refrigerant gas along the inner wall to centrifuge the refrigerant gas.

15. The compressor according to claim 14, wherein the inner wall of the oil separator has an axial dimension that is less than an inner diameter of the inner wall.

16. The compressor according to claim 14, wherein the oil separator has a cylindrical separation tube located within the oil separator, wherein the separation tube is spaced from the inner wall of the oil separator.

17. The compressor according to claim 16, wherein the oil separator has an axis extending in a radial direction of the compressor, wherein the separation tube is coaxial to the axis of the oil separator.

18. The compressor according to claim 16, wherein the oil separator further includes:

a first step formed on the inner wall;

a second step formed on an outer periphery of the separation tube; and a washer located between the first and second steps for defining a separation chamber and an outgoing cell within the cylindrical chamber configuration of the oil separator;

wherein the oil mixed with the refrigerant gas is separated in the separation chamber and introduced into the discharge passage through the outgoing cell.

19. The compressor according to claim 18, wherein the washer is cupped.

20. The compressor according to claim 18, wherein the washer is flat.

21. The compressor according to claim 1, wherein the cam plate is made of an aluminum-based material.

22. The compressor according to claim 21, wherein the cam plate includes hard particles.

23. A variable displacement type compressor having a crank chamber defined in a housing, a drive shaft rotatably supported by a housing, a plurality of cylinder bores defined in a cylinder block to surround the drive shaft, a piston that reciprocates within the associated cylinder bore, a supply passage for communicating a discharge chamber within the housing to the crank chamber, a discharge port associated with each cylinder bore, and a cam plate rotatable integrally with and supported tiltably on the drive shaft, wherein, when each piston reciprocates, a refrigerant gas is drawn into the associated cylinder bore from a suction chamber and discharged from the associated cylinder bore to the discharge chamber via the associated discharge port, and wherein, the amount of gas discharged from the bores is controlled by varying the inclination of the cam plate, the compressor comprising:

a collection compartment formed within the discharge chamber for receiving the refrigerant gas discharged from the cylinder bores;

first and second partitions provided within the discharge chamber for defining the collection compartment;

a discharge passage connected to the collection compartment for discharging the refrigerant gas from the compressor, the discharge passage having an inlet adjacent to the first partition, wherein the discharge passage inlet is open to the collection compartment, and wherein one of the discharge ports opens to the collection compartment, and the remaining discharge ports open to the discharge chamber;

an oil separator located in the collection compartment for recovering oil from the refrigerant gas and introducing the recovered oil to the supply passage; and a relief passage for connecting the crank chamber to the suction chamber, wherein the control valve varies the amount of refrigerant gas delivered from the crank chamber to the suction chamber via the relief passage in accordance with the adjustment of the opening amount of the supply passage to alter a pressure difference between the pressure in the crank chamber and the pressure in the cylinder bores, so that the inclination of the cam plate varies in accordance with the pressure difference.

24. The compressor according to claim 23, wherein the second partition guides the refrigerant gas toward the inlet of the supply passage and defines a passage for introducing the refrigerant gas from the discharge chamber to the collection compartment.

25. The compressor according to claim 23 further comprising an acceleration passage for accelerating the flow of the refrigerant gas, wherein the acceleration passage restricts the flow of gas upstream of the oil separator.

26. The compressor according to claim 23 further comprising a restriction provided in the supply passage to limit the flow of gas in the supply passage.

27. The compressor according to claim 23, wherein the oil separator includes a cylindrical chamber configuration having an inner wall for turning the refrigerant gas along the inner wall to centrifuge the refrigerant gas.

28. The compressor according to claim 27, wherein the inner wall of the oil separator has an axial dimension that is less than an inner diameter of the inner wall.

29. The compressor according to claim 27, wherein the oil separator has a cylindrical separation tube located within the oil separator, wherein the separation tube is spaced from the inner wall of the oil separator.

30. The compressor according to claim 29, wherein the oil separator has an axis extending in a radial direction of the compressor, wherein the separation tube is coaxial to the axis of the oil separator.

31. The compressor according to claim 30, wherein the oil separator further includes:

a first step formed on the inner wall;

a second step formed on an outer periphery of the separation tube; and a washer located between the first and second steps for defining a separation chamber and an outgoing cell within the cylindrical chamber configuration of the oil separator;

wherein the oil mixed with the refrigerant gas is separated in the separation chamber and introduced into the discharge passage through the outgoing cell.

32. A variable displacement type compressor comprising:

a housing;

a crank chamber defined in the housing;

a discharge chamber defined in the housing;

a suction chamber defined in the housing;

a drive shaft rotatably supported by the housing;

a cylinder block formed in the housing;

a plurality of cylinder bores defined in the cylinder block to surround the drive shaft;

a piston reciprocating within the associated cylinder bore to compress refrigerant gas;

a discharge port associated with each cylinder bore;

a cam plate tiltably supported on the drive shaft;

a collection compartment defined in the housing separately from the discharge chamber;

a supply passage for connecting the discharge chamber to the crank chamber, wherein an inlet of the supply passage opens to the collection compartment;

a connecting passage connecting the collection compartment and the discharge chamber so that the collecting compartment receives refrigerant gas discharged from the discharge ports via the connecting passage; and a discharge passage open to the collection compartment and connected to a muffler, wherein an outlet of the discharge passage is located in the collection compartment, and wherein, when each piston reciprocates, a refrigerant gas is drawn into the associated cylinder bore from the suction chamber and discharged from the associated cylinder bore to the discharge chamber via the associated discharge port, and wherein the amount of gas discharged from the bores is controlled by varying the inclination of the cam plate.

* * * * *